United States Patent [19]

Getsoian

[11] Patent Number: 5,076,812

[45] Date of Patent: Dec. 31, 1991

[54] COAL TREATMENT PROCESS AND APPARATUS THEREFOR

[75] Inventor: John A. Getsoian, Ann Arbor, Mich.

[73] Assignee: Arcanum Corporation, Ann Arbor, Mich.

[21] Appl. No.: 534,633

[22] Filed: Jun. 6, 1990

[51] Int. Cl.[5] ..... C10L 9/00

[52] U.S. Cl. ..... 44/282; 44/500; 44/629

[58] Field of Search ..... 44/500, 629, 282

[56] References Cited

U.S. PATENT DOCUMENTS

| | | | |
|---|---|---|---|
| 3,637,464 | 1/1972 | Walsh et al. | 201/6 |
| 3,664,824 | 5/1972 | Meadus et al. | 102/501 |
| 3,665,066 | 5/1972 | Capes et al. | 264/117 |
| 3,796,308 | 3/1974 | McIlhinney et al. | 209/9 |
| 3,941,679 | 3/1976 | Smith et al. | 208/390 |
| 3,975,194 | 8/1976 | Farnand et al. | 419/5 |
| 4,027,731 | 6/1977 | Smith et al. | 166/267 |
| 4,029,567 | 6/1977 | Farnand et al. | 288/433 |
| 4,033,729 | 7/1977 | Capes et al. | 44/282 |
| 4,055,480 | 10/1977 | Smith et al. | 208/390 |
| 4,082,515 | 4/1978 | Capes et al. | 23/313 R |
| 4,089,340 | 5/1978 | Smith et al. | 137/13 |
| 4,133,747 | 1/1979 | Visman | 209/10 |
| 4,151,003 | 4/1979 | Smith et al. | 106/278 |
| 4,156,596 | 5/1979 | Capes et al. | 44/23 |
| 4,173,530 | 11/1979 | Smith et al. | 209/9 |
| 4,178,231 | 12/1979 | Smith et al. | 209/3 |
| 4,178,233 | 12/1979 | Smith et al. | 209/3 |
| 4,186,887 | 2/1980 | Keller, Jr. et al. | 241/20 |
| 4,224,039 | 9/1980 | Smith et al. | 44/10 R |
| 4,244,699 | 1/1981 | Smith et al. | 44/15 R |
| 4,248,698 | 2/1981 | Keller, Jr. | 209/5 |
| 4,249,699 | 2/1981 | Smith et al. | 241/20 |
| 4,252,639 | 2/1981 | Smith et al. | 209/5 |
| 4,265,737 | 5/1981 | Smith et al. | 209/3 |
| 4,269,699 | 5/1981 | McCready et al. | 75/101 R |
| 4,274,946 | 6/1981 | Smith et al. | 209/5 |
| 4,284,413 | 8/1981 | Capes et al. | 44/51 |
| 4,303,505 | 12/1981 | Capes et al. | 209/5 |
| 4,447,245 | 5/1984 | Smith et al. | 44/15 R |
| 4,461,625 | 7/1984 | Smith et al. | 44/10 R |
| 4,484,928 | 11/1984 | Keller, Jr. | 44/15 R |
| 4,491,454 | 1/1985 | Lompa-Krzymien | 44/15 R |
| 4,515,602 | 5/1985 | Keller, Jr. | 44/51 |
| 4,539,010 | 9/1985 | Mainwaring et al. | 44/629 |
| 4,601,729 | 7/1986 | Capes et al. | 44/51 |
| 4,610,547 | 9/1986 | Bennett et al. | 366/270 |

FOREIGN PATENT DOCUMENTS

| | | | |
|---|---|---|---|
| 58-149996 | 9/1983 | Japan | 44/500 |

*Primary Examiner*—Prince Willis, Jr.
*Assistant Examiner*—Ellen McAvoy
*Attorney, Agent, or Firm*—Flynn, Thiel, Boutell & Tanis

[57] ABSTRACT

A process for demineralizing and agglomerating coal in which the coal is subjected to pulverization in order to separate mineral matters therefrom and resulting coal particles are agglomerated through the use of a bridging liquid and a binder. Oversided coal particles are recycled in a grinding circuit until they are reduced to an acceptable size and bridging liquid is removed from the microagglomerates of coal in a low shear reactor and recovered for reuse in the process.

8 Claims, 7 Drawing Sheets

COAL TREATMENT PROCESS AND APPARATUS THEREFOR

FIELD OF THE INVENTION

This invention relates to an improved process and apparatus for separating pyrites and other mineral matter from coal by subdividing raw coal into coal particles and forming agglomerates of product coal from the coal particles. The invention relates particularly to a process and apparatus for separating pyrites and other mineral matter from raw coal in which the coal particles of a desired size range are agglomerated in two stages using a bridging liquid and a binder, and the bridging liquid is azeotropically stripped from the agglomerates of product coal in the second stage.

Certain terms will be used hereinbelow for convenience in describing the invention. These terms have the following meanings.

- Raw coal is a composite of carbonaceous coal and mineral matter. It is the feedstock for the process. The raw coal may be coal as mined, with or without preliminary preparation.
- Product coal is the carbonaceous coal recovered from the process of the invention and containing a lower percentage of mineral matter than the raw coal from which it has been produced.
- Mineral matter is the inorganic matter present in raw coal and product coal.
- Ash is the noncombustible matter present in raw coal and product coal. Ash is related to, but is not necessarily identical with, mineral matter.

BACKGROUND OF THE INVENTION

Raw coal is typically a composite of coal, pyritic sulfur and various other mineral matters. Even though the cost of separating coal from the pyritic sulfur and mineral matters is fairly expensive, in most cases, prior to use, coal is cleaned to reduce the amount of the foreign material present in it because of environmental factors, economic considerations, such as the cost of transporting noncombustible material over extended distances, and limitations on the amount of noncarbonaceous materials which can be tolerated in the process in which the coal is to be used.

Many techniques for cleaning coal have heretofore been proposed and a number of them are in current commercial use including air separation, jigging, froth flotation, cycloning and shaking on Diester tables. However, these techniques have disadvantages in that they are often inefficient and only coal particles in a relatively narrow size range can be handled.

Another known method for the separation of coal from mineral matter including pyritic sulfur involves milling or otherwise comminuting raw coal until it has been reduced to a particle size not exceeding 250 microns. Since coal is softer and easier to grind than pyritic sulfur and other mineral matter, the comminution of coal to a particle size of under 250 microns effects a partial release or separation of the coal from the mineral matter. The raw comminuted coal is then slurried in an aqueous liquid, typically clean water, and the comminution of the raw coal is continued until the raw coal has been subdivided into separate particles of coal and mineral matter including pyritic sulfur. After this comminution step has been completed, an agglomerating agent is added to the slurry and the slurry is agitated. The agitation is continued until the coal particles have separated from the particles of mineral matter and from the aqueous phase of the slurry and have coalesced into agglomerates of product coal. The product coal agglomerates are recovered from the slurry.

These conventional milling or comminuting processes are not fully satisfactory for various reasons, for example, the agglomerating agent is not efficiently recovered and reused in the process and there is no provision for removing and recycling oversized coal particles resulting from the comminution step prior to their being introduced into the agglomeration stage. The mineral and pyrite materials will not be fully liberated from such oversize particles and the mineral and pyrite materials will not be fully rejected by the agglomeration process. As a consequence, the quality of the product coal will not be upgraded as much as is desired. Additionally, the product agglomerates are typically recovered in a dry condition in which they are extremely friable and present a fire hazard due to the flammability of the dry coal particles, i.e., coal dust.

One process uses low levels (1.5–5% by wt. of coal) of an oil, such as fuel oil or spent crankcase oil, as the bridging liquid, and leaves it all in the product coal. The low level of bridging liquid used results in a very fine, floc-like, agglomerate product, collected either by screening or flotation. This material typically contains 50 percent moisture by weight. Such a high moisture level is unacceptable to a coal operator, so this wet floc product is dewatered to approximately 15 percent moisture by means of centrifuges. This product, which now has an acceptable moisture content, nonetheless is very fine, with all the attendant handling problems caused by that characteristic, and still contains the bridging oil, a potential source of odor and volatile organic air pollution.

Another potential pollution problem of the process practiced as described above is that since the product coal is very fine, coal is more likely to be lost in the tailing stream from the separation. The lower the oil level used, the greater this problem usually is. This coal, lost in the tailings, also contains some of the hydrocarbon bridging liquid, which can then be lost to the environment on disposal of the tailings. In the case of the use of recycled or waste oils, which often are contaminated with heavy metals, this can lead to significant pollution problems.

A dangerous, dry, pyrophoric product is produced when the process includes thermal recovery of the bridging liquid.

Accordingly, it is an object of the present invention to provide a process and apparatus for efficiently separating pyritic sulfur and other mineral matter from raw coal and agglomerating the coal particles to form agglomerates by the use of an azeotropically strippable bridging liquid and a binder.

It is a further object of the present invention to provide a process and apparatus for efficiently recovering a bridging liquid used in a coal particle agglomeration process by azeotropically stripping the bridging liquid from the agglomerated coal particles immediately after the agglomerating steps have been performed.

It is a still further object of the present invention to provide a process and apparatus for forming product coal agglomerates which are recovered in a moist condition and thereby exhibit reduced friability and flammability.

Other objects and purposes of this invention will be apparent to persons acquainted with processes of this general type upon reading the following specification and inspecting the accompanying drawings.

SUMMARY OF THE INVENTION

The objects and purposes of the present invention are met by providing a process and an apparatus for demineralizing raw coal and agglomerating product coal by mixing an aqueous slurry of finely divided coal particles and particles of pyrites and other mineral matter, preferably having a particle size of less than 20 micrometers, with a relatively large amount of an organic, water-insoluble, steam-strippable, hydrocarbon, bridging liquid, under high shear conditions effective to wet the coal particles with the bridging liquid and convert same into microagglomerates. The amount of bridging liquid employed is from 15 to 55 percent by weight, preferably about 30 to 40 percent, by weight, based on the weight of carbonaceous coal, calculated on a moisture- and mineral-free basis. The aqueous slurry of the microagglomerates of coal and the particles of pyrites and other mineral matter are mixed together with an organic, water-insoluble binder, under low shear conditions effective to agglomerate the coal microagglomerates to form product coal agglomerates, then water and the particles of pyrites and other mineral matter are separated from the product coal agglomerates. Then steam is blown into and through the product coal agglomerates and thereby the bridging liquid is evaporated and removed from the product coal agglomerates. Alternatively, the product coal agglomerates are directly heated to generate steam in situ from the water contained in the agglomerates, which steam is effective to evaporate the bridging liquid from the agglomerates. Then the product coal agglomerates, substantially free of the bridging liquid, are recovered. In a preferred embodiment of the invention, raw coal and water are fed into a particle size reduction apparatus, such as a coarse ball mill, to pulverize the coal, release pyrites and other mineral matter from the coal and form an aqueous slurry containing coal particles, and particles of pyrites and other mineral matter. The aqueous slurry is fed to a means for separating the aqueous slurry into a first stream containing oversized coal particles and a second stream containing the remainder of the slurry, including proper-sized coal particles. The first stream is introduced into a second particle size reduction apparatus, such as a fine grinding mill, to reduce the size of the oversized coal particles contained therein and form a fine grinding mill discharge slurry. The fine grinding mill discharge slurry is commingled with the aqueous slurry from the coarse ball mill, and particles of pyrites and other mineral matter prior to feeding the aqueous slurry into the above-mentioned means for separating the aqueous slurry into the first and second streams. The second stream is combined with a bridging liquid and, optionally, a binder to form the feed stream for a high shear reactor. The high shear reactor feed stream is fed into the high shear reactor and is agitated therein under high shear conditions to form a slurry containing microagglomerates of the coal particles. The aqueous slurry discharged from the high shear reactor is mixed with a binder and then is fed to a low shear reactor. The slurry containing the microagglomerates and the binder is agitated in the low shear reactor to increase the size of the microagglomerates. The aqueous medium and the particles of pyrites and other mineral matter are removed from the low shear reactor, leaving the agglomerates of product coal therein. Steam is then injected into the low shear reactor or is generated in situ in the agglomerates by heating the agglomerates whereby to evaporate the bridging liquid from the agglomerates while leaving the binder in place in the agglomerates. Water is fed into the low shear reactor to cool and strengthen the agglomerates and form an aqueous product coal slurry containing the cooled and strengthened product coal agglomerates. The agglomerates are dewatered to obtain product coal agglomerates.

Additional objects and purposes of the invention are met by providing a system for performing the above process.

DETAILED DESCRIPTION

Figure 1:
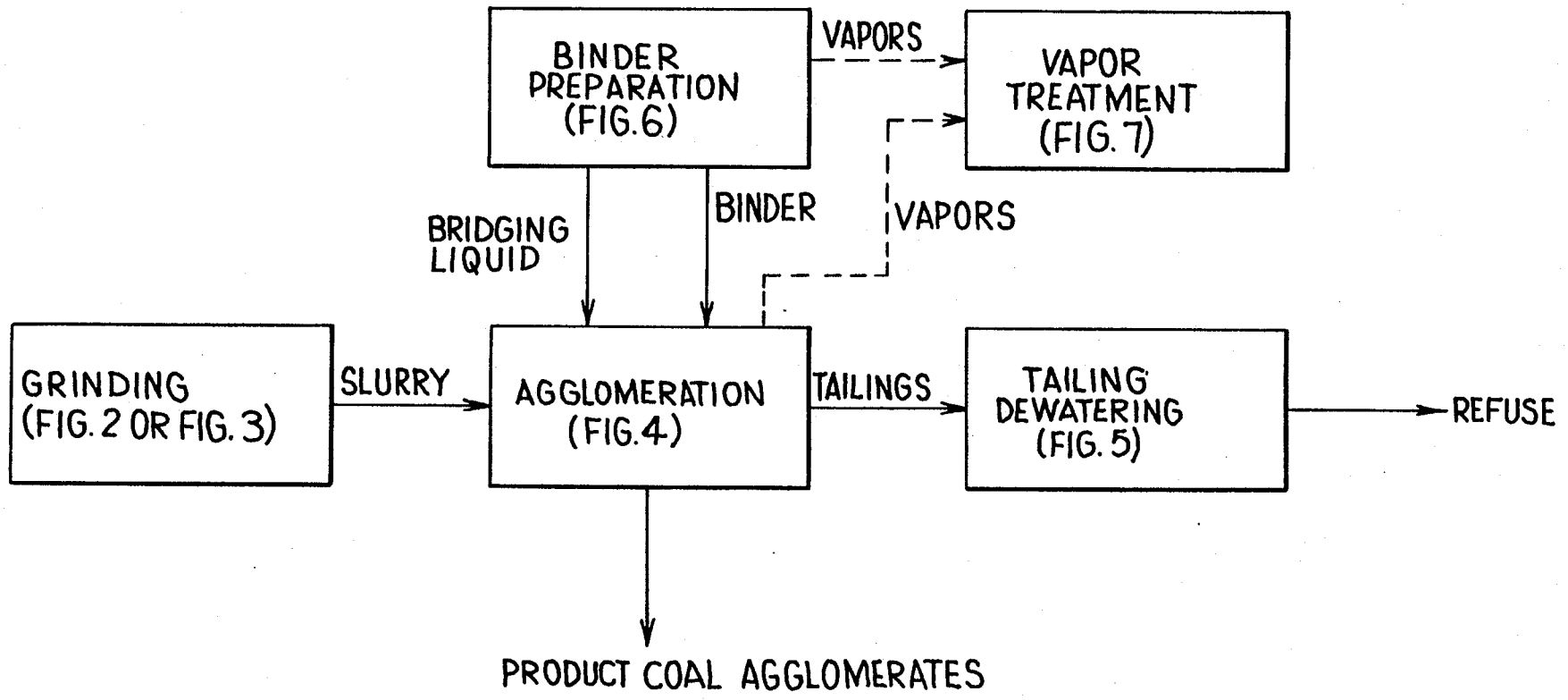
FIG. 1 is a block diagram illustrating the overall process.

Broadly speaking, the overall process is composed of grinding, binder preparation, agglomeration, tailing dewatering and vapor treatment procedures which are related to each other as illustrated in FIG. 1. The following description will refer to the individual procedures and describe them with reference to the drawing figures that illustrate the details of each procedure.

Figure 2:
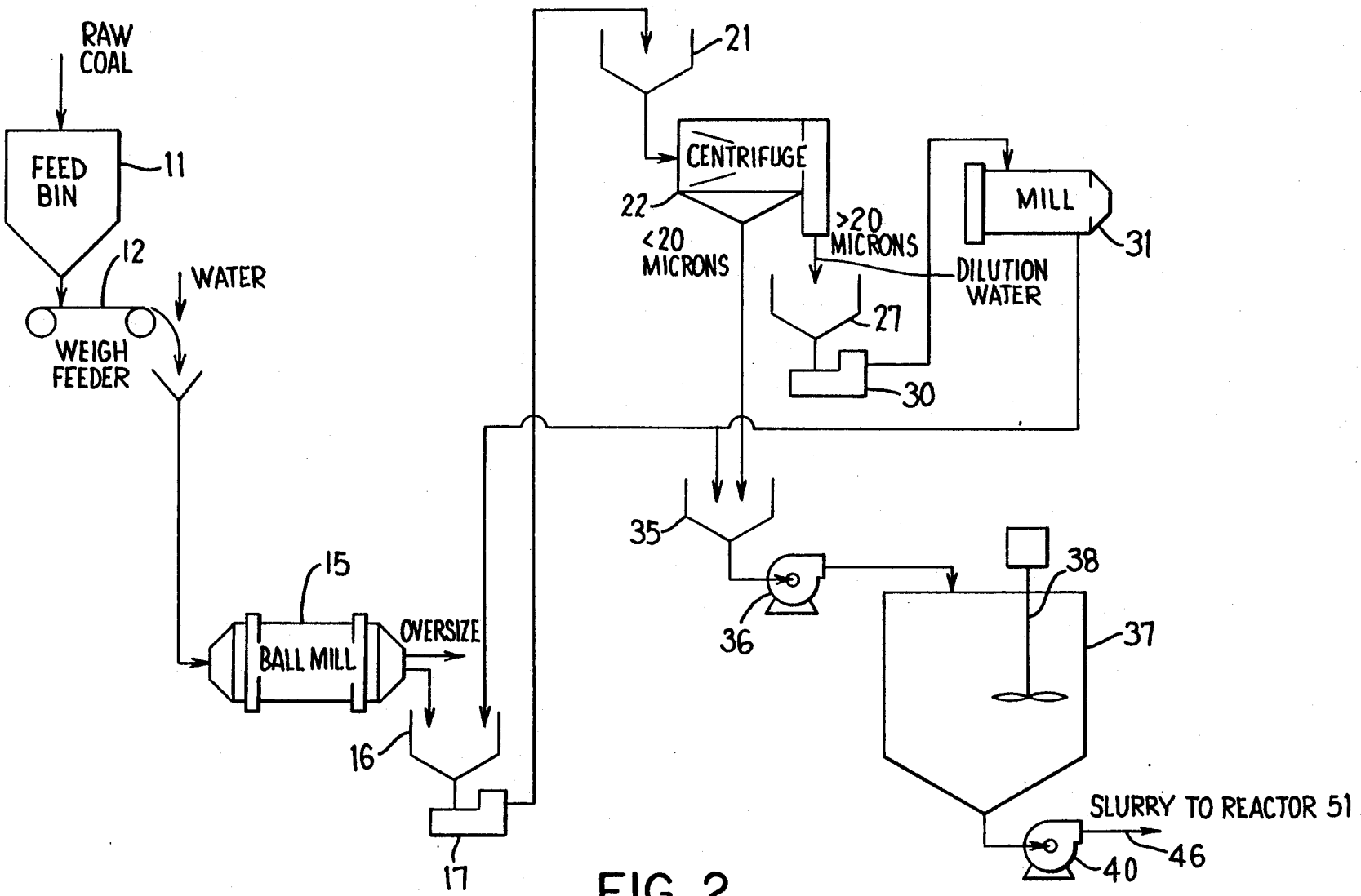
FIG. 2 is a flow diagram of an embodiment of the grinding circuit.

Referring to FIG. 2, the feedstock raw coal, crushed to an approximate size, such as approximately one-quarter inch in diameter, is received in a feed bin 11. The raw coal may be precleaned by any of the customary cleaning practices used in the coal industry or it may be coal as is recovered directly from the mine. The feed bin 11 is mounted on load cells to monitor the weight of coal contained in the bin. The bin 11 is additionally provided with a flow-assisting device (not shown), such as a vibrating hopper, a gyrating hopper, a whirlpool-type hopper or a vibrator, at its bottom to assist in the discharge of the coal from the bin 11. A weigh feeder 12 is located directly below the feed bin 11 and is adapted to deliver the coal to a particle size reduction apparatus, here a ball mill 15, at a controlled rate. Water and, if necessary, a grinding aid, are also added to the raw coal when it is about to enter ball mill 15. The feeds of raw coal and water to the ball mill 15 are such as to result in a solids concentration, in the slurry discharged from the ball mill, in the range of from 20–50 percent by weight, with about 35 percent by weight being typical.

The ball mill 15 is a conventional ball mill and contains a grinding medium, such as balls of steel, flint or ceramic. The ball mill 15 is operated so as to reduce the size of the raw coal to an average particle size of less than 50 microns. The coal particles have a D50 in the range of about 20–75 microns, with about 25 microns being average, and a D90 in the range of about 100–200 microns, with about 150 microns being average. By "D50" or "D90", it is meant that 50 percent or 90 percent, respectively, of the coal particles are smaller than the specified particle size. In the ball mill 15, the pyritic sulfur and other mineral matter are liberated from the coal during the comminution of the coal. A slurry containing coal particles, particles of pyritic sulfur and other mineral matter and water is produced in the ball mill 15 and discharged into a ball mill discharge sump 16. A trommel screen may be provided at the discharge end of the ball mill 15 in order to retain oversize material in the mill.

The slurry in the ball mill discharge sump 16 is then delivered by pump 17 to a centrifuge feed sump 21. From the centrifuge feed sump 21, the slurry is introduced into a centrifuge 22. The centrifuge 22 classifies the slurry at about 20 microns. The centrate slurry, containing minus 20 micron coal particles in water, flows by gravity to a primary sump 35. The centrate slurry typically has a solids content in the range of from about 8–30 percent by weight, with about 18 percent by weight being commonly employed. A stream containing the plus 20 micron coal particles is delivered, along with dilution water, as desired, from the centrifuge 22 to a fine grinding mill feed sump 27. A positive displacement pump 30, such as a Moyno pump, delivers the slurry containing the plus 20 micron coal particles to a fine grinding mill 31. The slurry containing the plus 20 micron coal particles has a solids content range of from about 20–50 percent by weight, with about 40 percent by weight being typical.

The fine grinding mill 31 comprises an abrasion-resistant horizontal cylinder fitted with a rotating agitator and filled with steel or ceramic beads. Due to the rotation of the agitator, the beads grind the coal particles to a very fine size. A substantial fraction of the coal particles in the discharge slurry from the fine grinding mill 31 have a particle size of smaller than 20 microns. The discharge slurry from the fine grinding mill 31 flows by gravity to the mill discharge sump 16 where it is mixed with the product slurry from the ball mill 15. Alternatively, the fine grinding mill discharge slurry can be sent to the primary sump 35.

Figure 3:
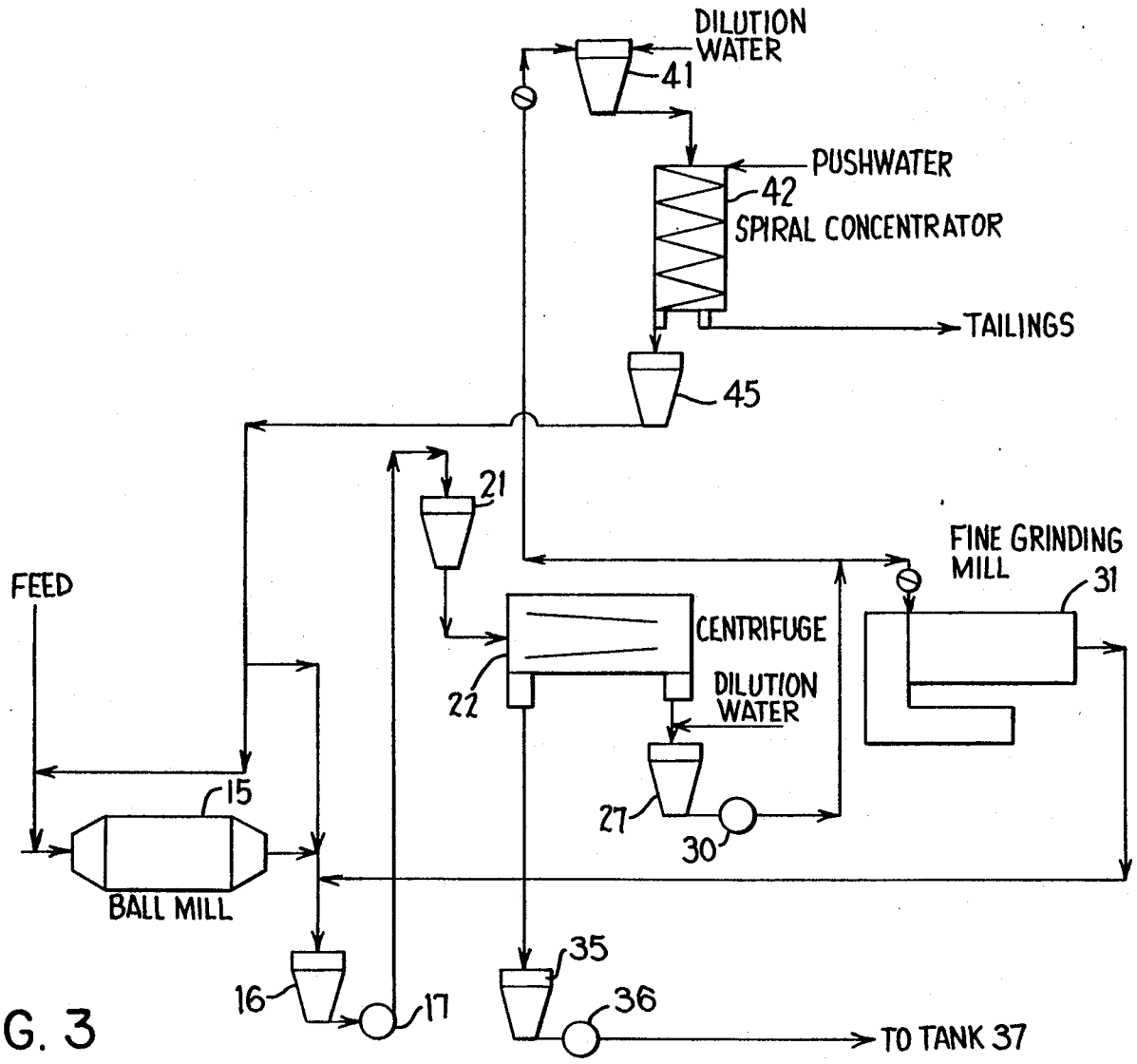
FIG. 3 is a flow diagram of an alternate embodiment of the grinding circuit in which a spiral concentrator is contained in the circuit.

As is shown in FIG. 3, the grinding circuit can also optionally include a coal separation device which operates primarily by differential separation, which device in the illustrated embodiment is a spiral concentrator 42, such as a Humphreys spiral concentrator. When a spiral concentrator 42 is contained in the grinding circuit, the plus 20 micron coal particle feedstream from the centrifuge 22 is split between both the fine grinding mill 31 and a spiral concentrator feed sump 41. Dilution water is added, as necessary, to the spiral concentrator feed sump and the resulting slurry is fed to the spiral concentrator 42. Since the discharge from the centrifuge 22 contains a narrowly sized particle size range from which the ultrafine material has been removed, the spiral concentrator 42 is extremely efficient in separating the pyritic sulfur and other heavy mineral matter from the coal particles. The concentrate recovered from the spiral concentrator 42 has a high ash and pyritic material content and it is delivered to the tailings section for treatment and disposal. The demineralized coal slurry is discharged from the spiral concentrator 42 into a spiral concentrator discharge sump 45 and from there it is either combined with the feed coal slurry entering the ball mill 15 or with the product slurry from the ball mill 15.

From the primary sump 35, the centrate stream containing minus 20 micron carbonaceous coal particles is delivered to a slurry feed tank 37 by a pump 36. An agitator 38 is provided in the slurry feed tank 37 in order to ensure that the minus 20 micron coal particles are evenly dispersed in the slurry. From the slurry feed tank 37, the slurry is pumped via conduit 46 to a high shear reactor 51 (FIG. 4) by a centrifugal pump 40.

Figure 4:
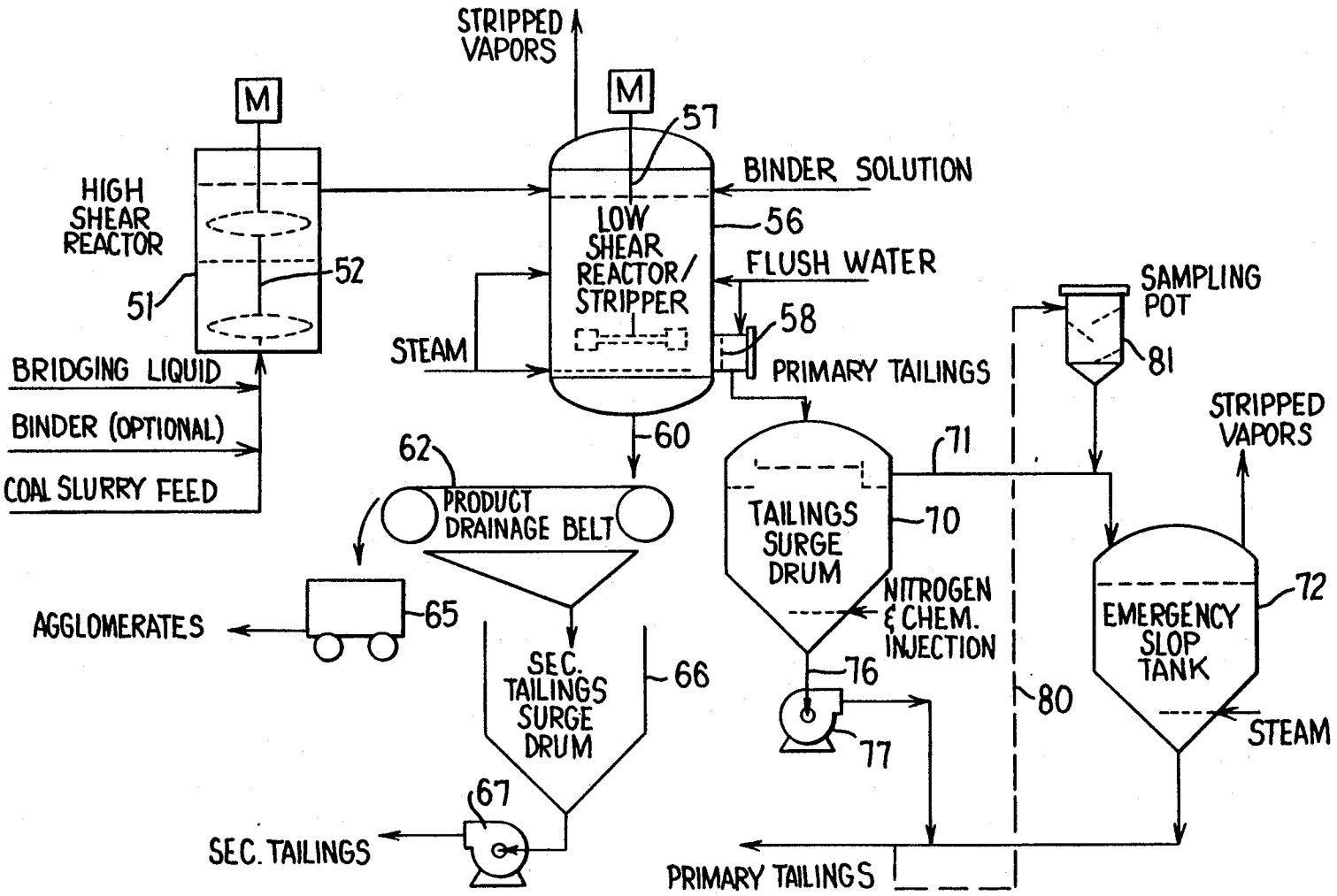
FIG. 4 is a flow diagram of the agglomeration section of the present invention.

Referring to FIG. 4, a bridging liquid and, optionally, a binder are added to the coal slurry feedstream from conduit 46 and the resulting mixture is delivered to the high shear reactor 51. The bridging liquid is typically a hydrocarbon and it disperses and subsequently displaces the water from the coal particle surfaces, thereby enabling small coal microagglomerates to form as the hydrocarbon layers coalesce during particle collisions. The bridging liquid is chosen for its ability to coalesce and separate the coal particles from the particles of pyritic sulfur and other mineral matter and for the ease of removing it from the agglomerates of product coal by azeotropic stripping. While many hydrocarbon liquids can be used in the present invention, the bridging liquid in the present invention preferably is an aliphatic saturated hydrocarbon having from 5 to 9 carbon atoms or mixtures thereof. Heptane is specially preferred. Heptane is particularly advantageous in the present invention because it forms an azeotrope of about 85–90 volume percent heptane to 10–15 volume percent water during stripping removal of the heptane from the agglomerates of product coal, as described hereinbelow. This enables the heptane to be completely removed from the agglomerates of product coal while sufficient water is still retained in the agglomerates to maintain them in a moist condition. The amount of bridging liquid fed to the high shear reactor 51 is usually in the range of about 15–55 percent by weight, based on the weight of the coal that is fed to the reactor 51, calculated on a moisture- and mineral matter-free basis. A common bridging liquid quantity is about 35 percent by weight.

The binder is added to the high shear reactor feed slurry stream when it is necessary to modify or control the surface properties of so-called "reluctant" coal particles. "Reluctant" coal particles are coal particles which exhibit a propensity against agglomeration under normal operating conditions. A specially preferred binder composition in the present invention comprises a solution of asphalt dissolved in the bridging liquid. The amount of asphalt in the binder can be varied according to the content of the slurry stream being processed. A particularly preferred range of asphalt content in the binder is up to about 50 percent by weight, based on the weight of the binder, with about 30 weight percent being specially preferred. The amount of binder fed to the high shear reactor 51 is up to 1 percent by weight, based on the weight of coal that is fed to the reactor 51, calculated on a moisture- and mineral matter-free basis, with from 0.25 to 0.5 percent of the binder being preferred.

The high shear reactor 51 is a vertical cylindrical vessel fitted with a variable speed agitator 52. The agitator is illustrated as being provided with two impellers. The agitation induced by the impellers in the high shear reactor 51 causes the particles of coal to become wetted with the bridging liquid and coalesce into microagglomerates. The carbonaceous coal particles, being hydrophobic, adhere to one another with the bridging liquid acting as a bridge between the particles and the binder aiding in the coagulating of the particles. Since the particles of pyritic sulfur and other mineral matter are hydrophilic, they are not wetted by the bridging liquid and remain in the water as finely dispersed particles. The high shear reactor 51 is operated so as to form microagglomerates of coal having a particle size of from about 0.2 to 1.2 millimeters. The temperature of the slurry in the high shear reactor 51 is not critical, provided that the bridging liquid is not vaporized. For example, when heptane is used as the bridging liquid, the temperature can be from ambient temperature up to about 140° F. From the high shear reactor 51, a continuous flow of slurry containing the microagglomerates is diverted batchwise in sequence (cyclic operation) to one of a plurality of vessels 56 at a time. In each vessel 56 a further agglomeration of the microagglomerates of coal particles is carried out under low shear conditions, followed by stripping of the bridging liquid. Only one of these vessels 56 is illustrated in FIG. 3. The vessels 56 will hereinafter be referred to as low shear reactors 56.

Figure 7:
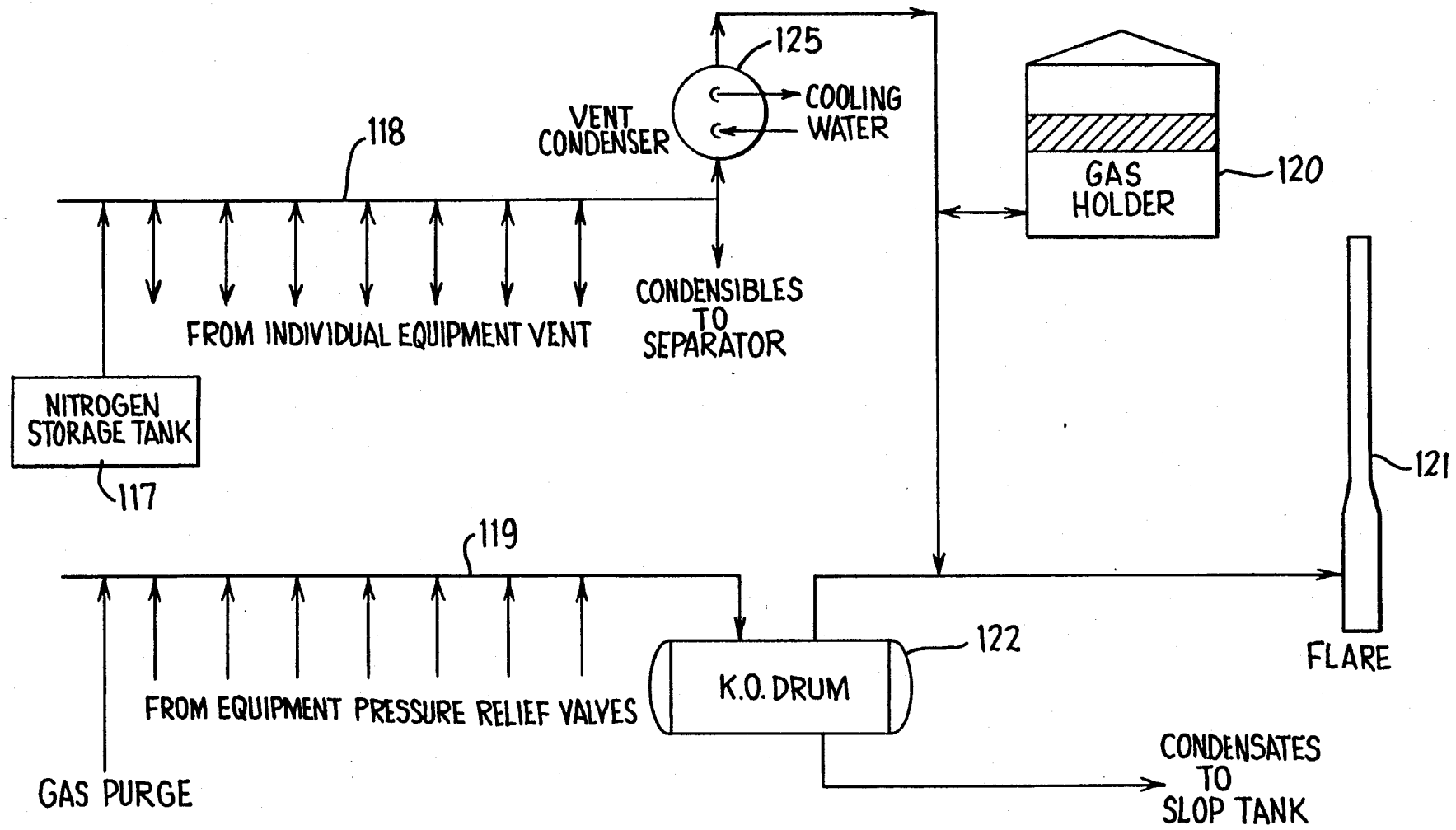
FIG. 7 is a flow diagram of the vapor phase handling section of the invention.

The operations of each of the plurality of low shear reactors 56 are identical so that the following description for the low shear reactor 56 illustrated in FIG. 3 will be applicable to all the low shear reactors. The low shear reactor 56 is a vertical cylindrical vessel fitted with a low shear, single blade, variable speed agitator 57. The low shear reactor 56 has a six-cycle sequence of operation. The six cycles are a filling cycle, a mixing-/agglomerating cycle, a dumping cycle, a bridging liquid stripping cycle, a reslurrying and dumping cycle and a standby cycle. During the filling cycle of the low shear reactor 56, the slurry from the high shear reactor 51 and a binder solution, which is a solution of asphalt dissolved in the bridging liquid, are fed into the low shear reactor 56. Upon reaching a preset level, the feeds of the slurry and the binder solution are stopped and the feeds of the slurry and binder solution are switched over to the next low shear reactor 56 in the series of low shear reactors. After the filling cycle is completed, the contents of the low shear reactor 56 are agitated to mix and agglomerate the microagglomerates of coal to obtain size-enlarged agglomerates of product coal having a suitable diameter, for example, from about ¼ to about ⅜ of an inch in diameter. At the end of the mixing/agglomerating cycle, an aqueous slurry of the tailings, which comprise the particles of pyritic sulfur and other mineral matter, is drained from the product coal agglomerates through a screen 58 located adjacent to the bottom of the low shear reactor 56. The aqueous slurry of the tailings is fed to a tailings surge tank 70. During the filling, mixing/agglomerating and dumping cycles of the low shear reactor 56, the reactor vapor space is joined to a nitrogen header 118 as shown in FIG. 7 to assure an oxygen-free atmosphere in the low shear reactor 56 and to prevent the escape of bridging liquid vapors into the local environment.

Figure 6:
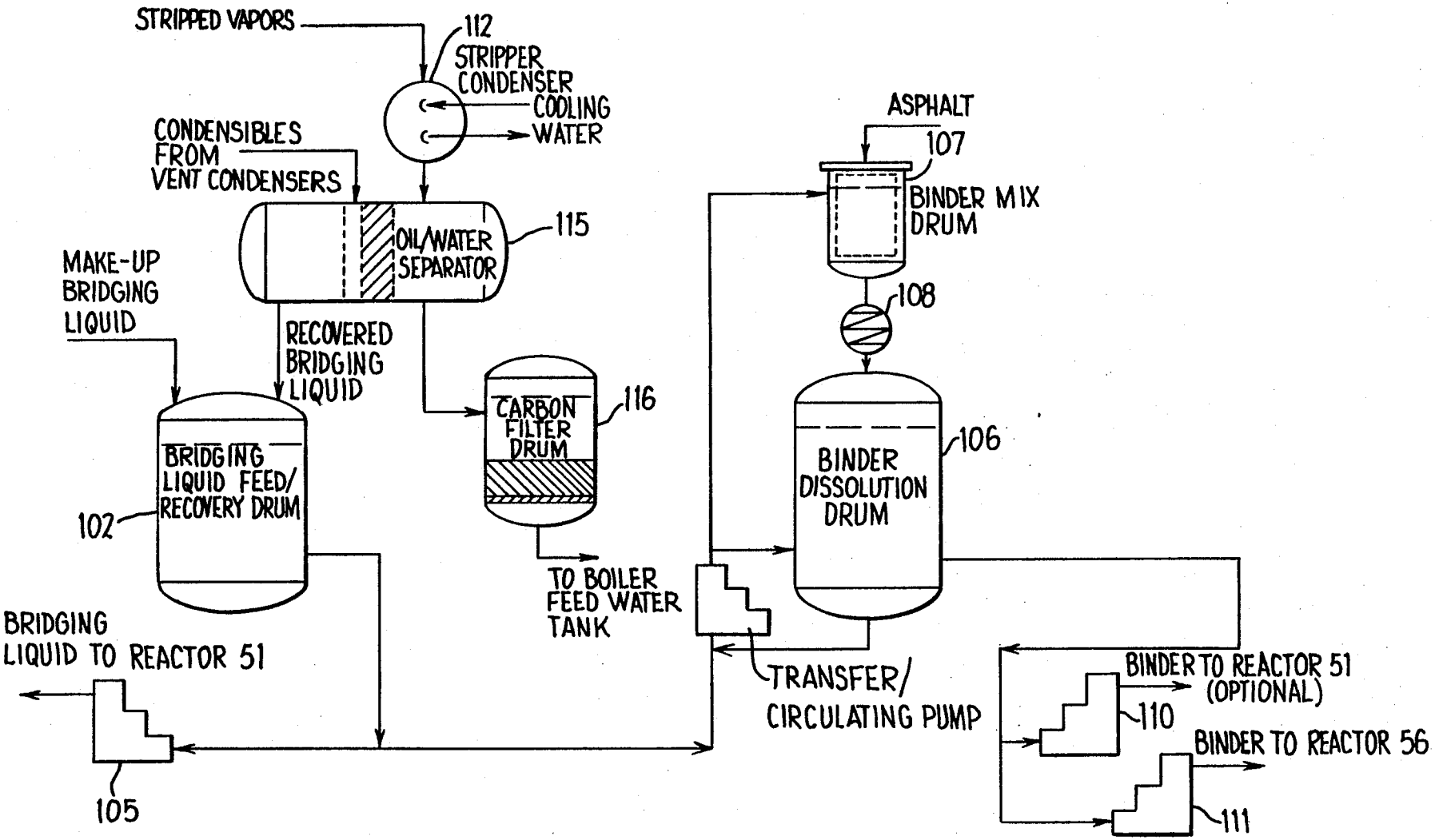
FIG. 6 is a flow diagram of the binder preparation section of the present invention.

In preparation for the bridging liquid stripping cycle, the vapor space of the low shear reactor 56 is connected to a stripper condenser 112 (FIG. 6). During the stripping cycle, a stripping medium, such as an inert gas or steam, is first introduced into the top of the low shear reactor 56 to sweep nitrogen from the reactor and warm up the upper end of the low shear reactor to prevent bridging liquid from condensing on cool reactor surfaces and thereby refluxing. The stripping medium, preferably steam, is then fed into the bottom of the low shear reactor 56 to evaporate and remove all of the bridging liquid from the product coal agglomerates. Alternatively, the contents of the low shear reactor can be heated to generate steam in situ in the reactor, which steam evaporates and removes the bridging liquid. It is to be remembered that the agglomerates contain an azeotrope of the bridging liquid and water so that the water can be converted into steam, in situ, by heating. The bridging liquid vapors and steam from the reactor 56 are condensed and subcooled in the stripper condenser 112 (FIG. 6). The condensed bridging liquid and water are separated by gravity in a bridging liquidwater separator 115. The recovered bridging liquid is fed by gravity to a bridging liquid feed/recovery drum 102. The recovered water is sent to a carbon absorption drum 116 where the remaining traces of bridging liquid are removed.

At the end of the stripping cycle, the coal agglomerates are free of the bridging liquid. During the following reslurrying and dumping cycle, the vapor space of the low shear reactor 56 is connected to the nitrogen header 118. The low shear reactor 56 is then partially filled with water in order to cool and strengthen the product coal agglomerates. The dump valve of the low shear reactor 56 is then opened and the suspension of agglomerates in water is discharged at 60 onto a horizontal product drainage belt 62. Additional water can be sprayed into the low shear reactor 56 via tangential sprays contained in the sides and bottom of the reactor in order to assist in flushing solids from the reactor. The product coal agglomerates are dewatered on the moving horizontal product drainage belt 62. Additional water sprays can be employed to clean the product drainage belt 62 and rinse the agglomerate surfaces of any residual tailings. The product coal agglomerates, in a moist, cool and dewatered state, are loaded into a dumpster 65 and ready for shipment or use as a fuel.

The water from the product drainage belt 62 and the flushing water are collected in a secondary tailings surge drum 66. Before the next dumping of the product coal agglomerates, the contents of the secondary tailings surge drum 66 are pumped down to a preset low liquid level and sent to a tailings sump 82 (FIG. 5).

In the tailings surge drum 70, any coal particles laden with bridging liquid, which would unintentionally pass through the low shear reactor screen 58, will float and will be collected as an overflow to an emergency slop tank 72. To ensure that all of the bridging liquid-laden solids are floated and removed from the overflow, a small stream of nitrogen may be bubbled, if needed, into the tailings surge drum 70. A surfactant may also be introduced into the drum 70 in order to enhance the flotation of the solids. To reduce nitrogen consumption, the nitrogen vented from the drum 70 may be recycled via a compressor.

The tailings surge drum 70 is operated in a batch fashion with the liquid level being measured before and after each low shear reactor 56 drain in order to determine the quantity of the primary tailings. Before the next draining, the contents of the tailings surge drum 70 are removed down to a preset liquid level and sent to the first tailing sump 82 (FIG. 5). If the primary tailings in drum 70 contain too much hydrocarbon-bearing coal material so that they should not be pumped to the water reclamation system (FIG. 5), such tailings are held in the drum 70. The next discharge of material from the reactor 56 will cause the hydrocarbon-bearing materials to overflow into the slop tank 72 wherein they can be subjected to steam stripping of the hydrocarbon.

Figure 5:
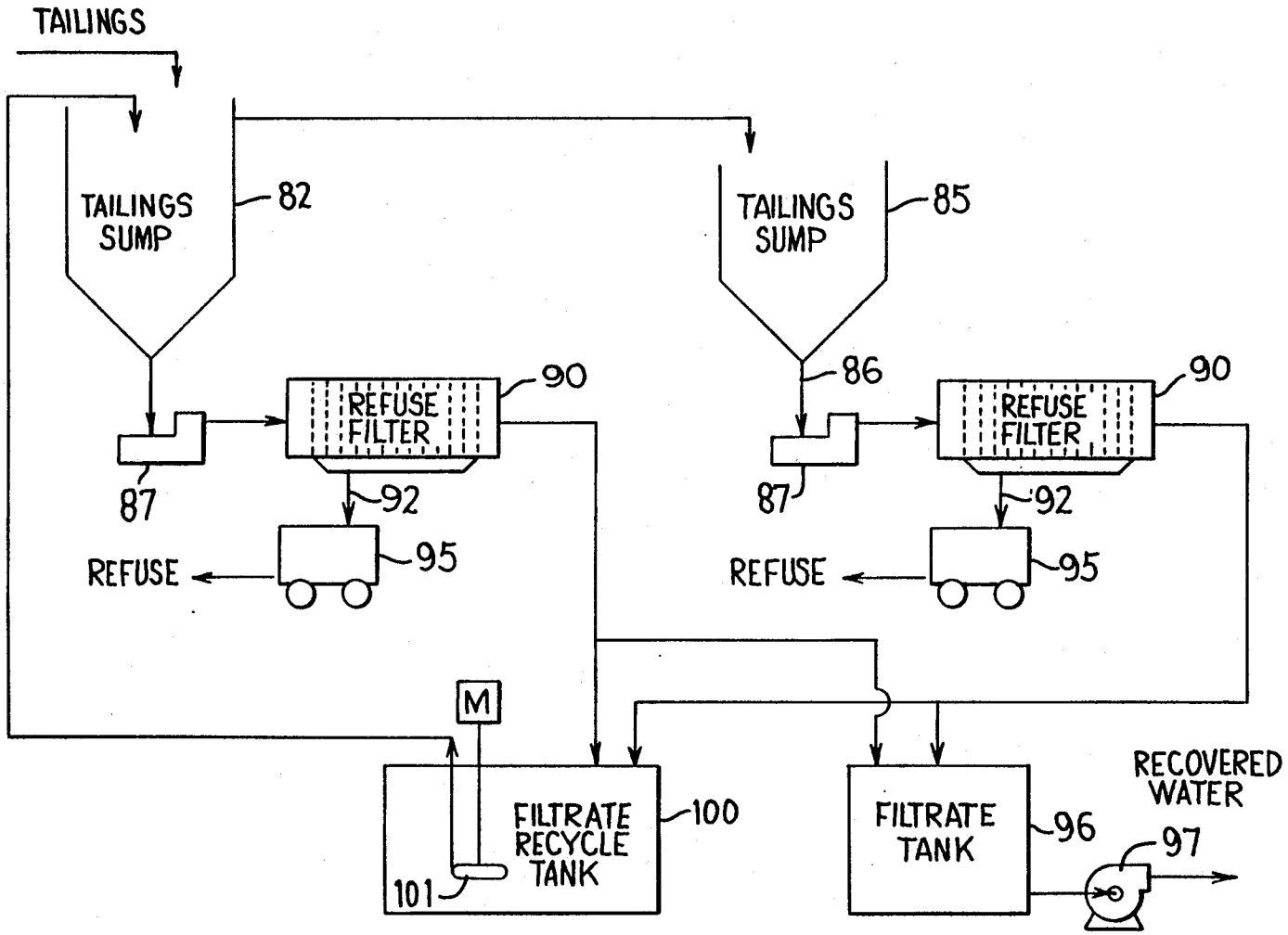
FIG. 5 is a flow diagram of the tailings dewatering section of the present invention.

As shown in FIG. 5, two tailing sumps 82 and 85 and two filters 90 are provided so that the filters can be operated cyclically whereby one can operate while the other is being cleaned, and vice versa. A sampler may be provided to monitor the tailings streams into the tailings sumps 82 and 85 to detect any breakthrough of bridging liquid to the downstream equipment. If any explosive gas is detected, alarm and plant shutdown procedures are automatically initiated. High-pressure piston pumps 87 feed the tailings to filters 90 from the tailings sumps 82, 85 in order to separate the pyrites and other mineral matter from the water. The filters can be standard plate-and-frame filter presses typically used as refuse filters. The dewatered filter cake 92 is discharged directly into dumpsters 95 and disposed of.

The filtrate can be sent to either the filtrate tank 96 or a filtrate recycle tank 100, depending on the amount of particulates contained in the filtrate. If the filtrate is found to contain excessive amounts of particulates, the filtrate is sent to the filtrate recycle tank 100. From here, the filtrate is returned via pump 101 to the tailings sump 82 for another pass through the refuse filters 90. When clear filtrate is produced, it is sent directly to the filtrate tank 96. From there, the recovered water is returned by pump 97 to a water surge tank for reuse in the process.

The bridging liquid and binder mixture preparation are illustrated in FIG. 6. The bridging liquid is placed in a bridging liquid feed/recovery drum 102. The drum 102 holds enough bridging liquid to provide a suitable supply of the bridging liquid/asphalt binder mixture, for example, an eight-hour supply. The bridging liquid is fed to the high shear reactor 51 (FIG. 4) by metering pump 105, which meters bridging liquid flow to the high shear reactor 51.

To make up a batch of binder solution, the binder mix drum 107 is isolated and purged with nitrogen until no hydrocarbon vapor is detected. Binder mix drum 107 is then opened and a suitable amount of asphalt chunks is placed into a perforated basket within the drum. The binder mix drum top is then secured and the vessel again purged with nitrogen until the oxygen content is reduced to 2 percent or less. Enough bridging liquid to provide the reqired binder/bridging liquid concentration is then charged to the binder dissolution drum 106 and circulated through the binder mix drum 107 and back to the binder dissolution drum 106 until all of the asphalt is dissolved. Optionally, heating may be applied in the circulation system to speed dissolution. During process operation the contents of the binder feed drum 106 are continually circulated to insure that no asphalt solids settle out. The binder mix is fed from the binder dissolution drum 106 to the low shear reactor 56 by metering pump 111 and optionally to the high shear reactor 51 by metering pump 110. The asphalt/ bridging liquid mixtures can be made up anytime before the running of the inventive process. Alternatively, a separate binder solution storage vessel may be added to allow concurrent binder preparation and process operation.

The vapor handling system of the present invention is illustrated in FIG. 7. To ensure an oxygen-free atmosphere in the bridging liquid-containing vessels and to prevent the escape of bridging liquid vapors into the ambient environment, a closed inert gas blanketing system is used. Any vapor displacement in the system caused by temperature or liquid level changes is absorbed by a variable volume gas holder 120. The gas holder 120 maintains the system at a positive pressure, for example, about six inches of water. The only gas that is normally vented from the system will be the vapor displaced by a small amount of nitrogen used for purges. The vented gas is sent to a flare 121 where any combustible gases present are burned. Excess gas generated during upsets, such as cooling water failure, is vented to the flare 121, which is equipped with a pilot light. In addition, the nitrogen used for purging of equipment during start-ups, shutdowns and maintenance is vented through the flare 121. The closed system is provided with a condenser 125 which condenses and recovers most of the bridging liquid vapors contained in the system. This minimizes the loss of bridging liquid in the normal venting operation and minimizes the chance of the bridging liquid condensing in the gas holder 120. Any material condensed in the gas holder is drawn off to a closed container, sealed, labeled and sent to an appropriate disposal site. The system will be filled with nitrogen from a liquid nitrogen storage tank 117 and maintained at pressure by bleeds from the liquid nitrogen tank 117, which are controlled by the level in the gas holder 120.

The bridging liquid-containing vessels are also protected from overpressure by a closed pressure relief system 119 tied to the same flare 121. Each bridging liquid-containing vessel that can be isolated from any other bridging liquid-containing vessel is provided with a spring-activated relief valve which will relieve the vessel to the closed system in the event of overpressure. A relief knockout drum 122 is provided just upstream of the flare 121 to knock out any liquids present in the system. The collected liquid is then sent to the emergency slop tank 72. In addition, hydrocarbon sensors can be placed throughout the process to detect bridging liquid leaks. A positive hydrocarbon detection signal triggers alarms and directs the building ventilation system to begin maximum fresh air ventilation. If the leak remains detectible for a preset period of time, total process shutdown procedures are initiated.

The example which follows describes a test illustrating the novel aspects of the present invention.

EXAMPLE

Illinois #6 coal from Burning Star Mine in Perry County, Illinois, was used as the feed coal in the process of the present invention. The run-of-mine coal had the following composition. All percentages (%) are percent by weight.

TABLE 1

| | | |
|---|---|---|
| Ash | 16.47% | |
| Heating Value - Exp | 11854 | Btu/lb |
| Heating Value - Correlated | 11856 | Btu/lb |
| Total Sulfur | 3.07% | |
| Pyritic Sulfur | 0.99% | |
| Pyritic S02MMBTU | 1.67 | lbs. |
| Particle D90 | 19.31 | μm |
| Particle D50 | 7.59 | μm |

Heptane was used as the bridging liquid and asphalt was used as the binder. The binder solution used in the low shear reactor consisted of 30.5 wt. % asphalt, the remainder being heptane. The results of the processing of the Illinois #6 coal are set forth in Table 2.

TABLE 2

| Physical Data | |
|---|---|
| Bridging Liquid Sp.Gv. | 0.695 |

TABLE 2-continued

| | | |
|---|---|---|
| Binder Sp.Gv. | 1.050 | |
| Coal Sp.Gv. (MF) | 1.300 | |
| Mineral Sp.Gv. | 2.900 | |
| Est. Feed Solids Sp.Gv. | 1.430 | |
| Feed Concentrations | | |
| Slurry Solids Content | 12.58% | |
| Binder Solution Conc. | 30.50% | |
| Process Settings | | |
| Feed Flow Rate | 17.50 | gpm |
| High Shear Reactor Agitator Speed | 1805 | rpm |
| Low Shear Reactor Agitator Speed | 82 | rpm |
| Binder Sol. Rate to High Shear Reactor | 2.71 | gph |
| Binder Sol. Rate to Low Shear Reactor | 12.52 | gph |
| Heptane Feed Rate to High Shear Reactor | 63.75 | gph |
| Total Slurry Volume Fed | 490 | gal |
| Total Slurry Weight Fed | 4242 | lbs |
| Solids Feed Rate | 1144 | lbs/hr |
| Total Solids Fed | 534 | lbs |
| Coal Feed Rate (mmf) | 955 | lbs/hr |
| Total Coal Fed (mmf) | 446 | lbs |
| Heptane Vol. to High Shear Reactor | 29.75 | gal |
| Binder Sol Vol. to High Shear Reactor | 1.26 | gal |
| Binder Sol Vol. to Low Shear Reactor | 3.13 | gal |
| Total Volume to Low Shear Reactor | 524.14 | gal |
| Product Summary | | |
| Analyses | | |
| Product Ash | 3.82% | |
| Total Sulfur | 2.73% | |
| Pyritic Sulfur | 0.37% | |
| Heating Value - Exp | 13942 | Btu/lb |
| Heating Value - Correlated | 13975 | Btu/lb |
| Refuse Ash | 86.36% | |
| Refuse Total Sulfur | 4.93% | |
| Asphalt-Free Yield | 84.81% | |
| Total Weight Yield | 87.76% | |
| Total Product Wt. (via wt. yield) | 485 | lbs |
| Gross Product Wt. Recovered | 761 | lbs |
| Product Moisture | 42.47% | |
| Net Product Wt. Recovered | 438 | lbs |
| Asphalt-Free Ash | 3.93% | |
| Asphalt-Free Heating Value | 13849 | |
| Asphalt-Free BTU Recovery | 99.07% | |
| Agglom Pyritic S02/MMBTU | 0.53 | lbs |
| Agglom Pyritic S02 Reduction/MMBTU | 68.29% | |
| Product Binder Conc. | 3.36% | |
| Total Bl. Conc. % of Feed Coal | 33.09% | |
| Steam/MTON Product | 7424.85 | lbs |
| High Shear Work/MTON Product | 26.87 | kWhr |
| Low Shear Work/MTON Product | 28.67 | kWhr |

Although the preferred embodiments of the invention have been specifically described, it is distinctly understood that the invention may be embodied in still other specific forms without departing from the spirit or essential characteristics thereof. The embodiments of the invention disclosed above and in the drawings are, therefore, to be considered in all respects as illustrative and not restrictive.

The embodiments of the invention in which an exclusive property or privilege is claimed are defined as follows:

1. A process for obtaining product coal agglomerates, which comprises mixing an aqueous slurry of finely divided coal particles and particles of pyrites and other mineral matter with an organic, water-insoluble, steam-strippable, bridging liquid selected from the group consisting of aliphatic saturated hydrocarbons having from 5 to 9 carbon atoms and mixtures thereof, under high shear conditions effective to wet the coal particles with the bridging liquid and convert same into microagglomerates, then mixing the aqueous slurry of said microagglomerates of coal and said particles of pyrites and other mineral matters together with an organic, water-insoluble binder comprising asphalt and the bridging liquid, under low shear conditions effective to agglomerate said microagglomerates to form product coal agglomerates, then separating water and said particles of pyrites and other mineral matter from said product coal agglomerates, then heating said product coal agglomerates and thereby evaporating and removing said bridging liquid from said product coal agglomerates, and then recovering said product coal agglomerates substantially free of said bridging liquid.

2. A process for demineralizing and agglomerating coal comprising the steps of:

combining an aqueous slurry containing coal particles and mineral matter with a bridging liquid selected from the group consisting of aliphatic saturated hydrocarbons having from 5 to 9 carbon atoms and mixtures thereof to form a high shear reactor feed stream; introducing the high shear reactor feed stream into a high shear reactor and agitating it herein to form a slurry containing microagglomerates of the coal particles; feeding the slurry containing microagglomerates and feeding a binder comprising asphalt and the bridging liquid to a low shear reactor; agitating the slurry containing microagglomerates and the binder in said low shear reactor to increase the size of the microagglomerates to form agglomerates; injecting steam into the low shear reactor or heating the agglomerates to generate steam in situ therein so that the steam removes the bridging liquid from the agglomerates; feeding water into the low shear reactor to cool and strengthen the agglomerates and form a product slurry containing said cooled and strengthened agglomerates; separating said agglomerates from the product slurry; dewatering the agglomerates to form product agglomerates; and recovering said product agglomerates.

3. The process of claim 2, wherein said bridging liquid is heptane.

4. The process of claim 2, wherein said minerals are separated from said coal particles in said high shear reactor.

5. The process of claim 2, wherein said microagglomerates formed in said high shear reactor are from about 0.2 to 1.2 mm in diameter.

6. An apparatus for demineralizing and agglomerating coal comprising:

reactor means and means for feeding an aqueous slurry containing coal particles and minerals into said reactor means, said reactor means being adapted for forming a slurry containing microagglomerates of the coal particles; reactor/stripper means for enlarging the size of the microagglomerates in the slurry containing microagglomerates of the coal particles and subsequently stripping a bridging liquid selected from the group consisting of aliphatic saturated hydrocarbons having from 5 to 9 carbon atoms and mixtures thereof from the enlarged microagglomerates; and means for dewatering the enlarged microagglomerates and forming product agglomerates.

7. An apparatus for demineralizing and agglomerating coal comprising:

means for feeding an aqueous slurry containing coal particles and minerals; first reactor means for receiving said aqueous slurry from said feeding means for forming microagglomerates of the coal particles and a bridging liquid selected from the group consisting of aliphatic saturated hydrocarbons having from 5 to 9 carbon atoms and mixtures thereof; second reactor means for enlarging the size of the microagglomerates in the slurry containing microagglomerates of the coal particles; and means for dewatering the enlarged microagglomerates and forming product agglomerates.

8. A process for demineralizing raw coal and agglomerating product coal which comprises the steps of:

mixing (1) an aqueous slurry consisting essentially of from 8 to 30 percent by weight, based on the weight of said slurry, of coal particles, particles of pyrite and other mineral matter, and the balance is water, all of said particles having a particle size of less than about 20 microns, with (2) from 15 to 55 percent by weight of heptane, based on the weight of said coal particles, under high shear conditions so that the heptane wets the coal particles and causes same to agglomerate whereby to obtain an aqueous slurry consisting essentially of microagglomerates of said coal particles and containing said heptane, together with said particles of pyrite and other mineral matter and the balance is water, said microagglomerates having a particle size of from about 0.2 to 1.2 mm; then mixing said aqueous slurry with a solution of asphalt dissolved in heptane wherein the amount of asphalt added is from 1 to 10 percent by weight of asphalt, based on the weight of said coal particles, under low shear conditions effective to agglomerate said microagglomerates to form product coal agglomerates containing said asphalt and heptane, said product coal agglomerates being dispersed in said aqueous phase; then removing said water, said particles of pyrite and other mineral matter from said product coal agglomerates; then blowing steam into and through said product coal agglomerates to evaporate heptane therefrom whereby to obtain said product coal agglomerates substantially free of heptane and containing a reduced amount of pyrites and other mineral matter; then adding water to said product coal agglomerates to strengthen said product coal agglomerates whereby to obtain an aqueous suspension of said heptane-free product coal agglomerates; then separating water from said suspension and recovering said heptane-free product coal agglomerates.

* * * * *

UNITED STATES PATENT AND TRADEMARK OFFICE

CERTIFICATE OF CORRECTION

PATENT NO. : 5,076,812

DATED : December 31, 1991

INVENTOR(S) : John A. Getsoian

It is certified that error appears in the above-indentified patent and that said Letters Patent is hereby corrected as shown below:

On the Title page, item [57], in the Abstract, col. 2, line 5, change "oversided" to ---oversized---.

Signed and Sealed this

Fifteenth Day of June, 1993

*Attest:*

Michael K. Kirk

MICHAEL K. KIRK

*Attesting Officer*

*Acting Commissioner of Patents and Trademarks*